United States Patent [19]

Ghislain

[11] Patent Number: 4,959,905

[45] Date of Patent: Oct. 2, 1990

[54] PIZZA KNIFE AND HOLDER

[76] Inventor: Michael Ghislain, 1151 Medinah Way, Twin Lakes, Wis. 53181

[21] Appl. No.: 372,425

[22] Filed: Jun. 26, 1989

[51] Int. Cl.[5] ..... B26B 3/06

[52] U.S. Cl. ..... 30/298.4; 30/151; 30/340

[58] Field of Search ..... 30/286, 181, 142, 143, 30/144, 138, 296.1, 340, 298.4

[56] References Cited

U.S. PATENT DOCUMENTS 1,838,492 12/1931 Meyers ..... 30/286

*Primary Examiner*—Douglas D. Watts
*Assistant Examiner*—Willmon Fridie, Jr.
*Attorney, Agent, or Firm*—Cook, Egan, McFarron and Manzo, Ltd.

[57] ABSTRACT

A food cutting device is disclosed which has particular application in cutting pizza pies and the like. A dull, convexly curved blade attached to concavely curved handle extending over the entire length of the blade allows the user to sever a pizza pie in a smooth rocking motion. The cutting device may be stored during non-use in a holder having an elongated receptacle for receiving the blade of the cutting device.

13 Claims, 3 Drawing Sheets

FIG. 5
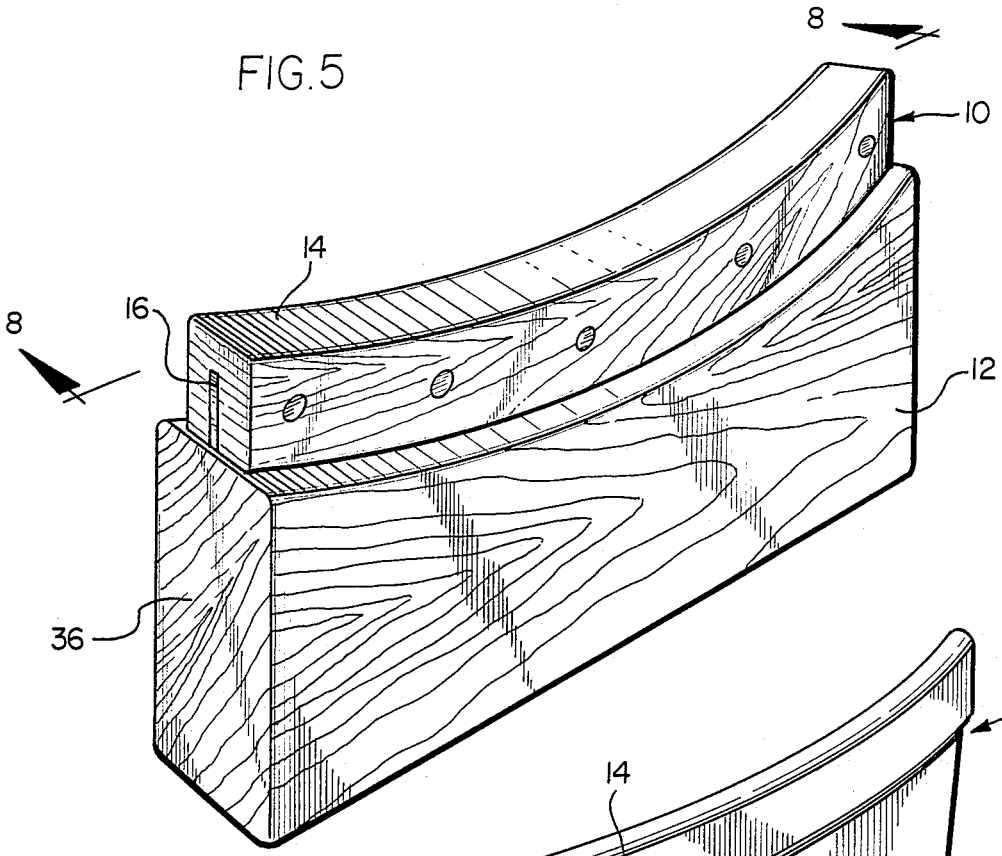
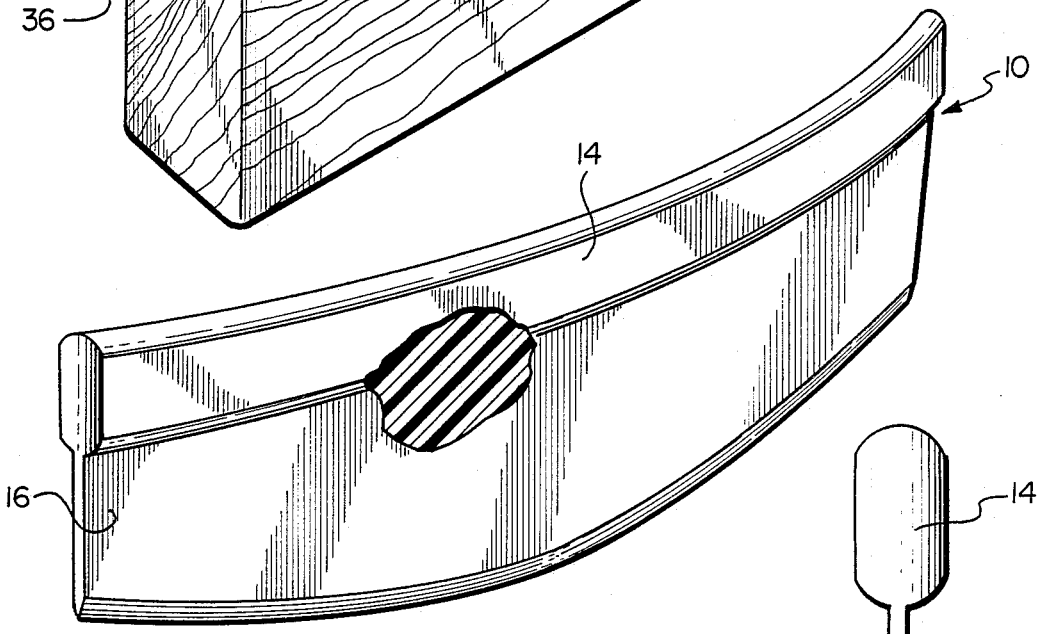
FIG. 9
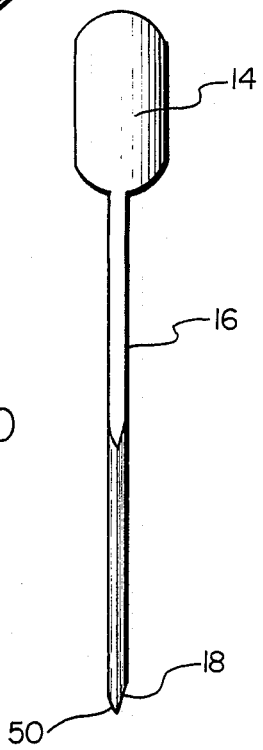
FIG. 10

PIZZA KNIFE AND HOLDER

BACKGROUND OF THE INVENTION

The present invention is related generally to food cutting devices and more specifically, to a device for cutting pizza pies and the like The prior art discloses several devices which may be used for cutting pizza and other foods. One such device is described in U.S. Pat. No. 4,423,551. The device described in the '551 patent is directed to the traditional roller and handle assembly commonly used in pizza cutting. Another pizza cutter is shown in U.S. Pat. No. 4,574,479. This device includes a handle and a convexly curved blade, wherein the blade is wide enough to also serve as a spatula for lifting the pizza out of a pan. U.S. Pat. No. 3,890,707 discloses the more traditional kitchen knife which is not limited to cutting pizza, but may also be used to cut, slice or chop other foods. This device has a blade with a smoothly curved cutting edge and a handle fitted on the back of the blade in an area adjacent to the rear end.

Although the devices described in the prior art have generally worked when used to slice the standard thin crust pizza, as the variety of available pizza has increased to include "pan", "deep dish", and "stuffed" pizza, certain drawbacks associated with the available cutting devices have become evident. For example, because the devices of the prior art generally have thin blades and small handle areas, they are often awkward and clumsy to use, particularly with pizza having a thicker crust or a thicker layer of toppings (e.g., "pan", "stuffed"). Specifically, the thin blade as well as the size and position of the handle in the prior art devices limit the amount of force that can be applied during cutting, often requiring the user to exert added energy to make a single cut.

Another disadvantage with the prior art is that all of the cutting devices described above require regular sharpening and upkeep in order to maintain the effectiveness of the cutting blade. Consequently, a sharp blade can make the available devices more dangerous, especially if misused or mishandled in any way.

Accordingly, the object of the present invention is to provide a safe, useful cutting device for cutting pizza (and other foods) in a quick and smooth motion with minimal upkeep and maintenance of the blade portion of the cutting device.

SUMMARY OF THE INVENTION

The present invention is directed to a food cutting device having an elongated blade and elongated handle located directly above the blade. The food cutting device of the present invention may be stored in a holder during non-use.

The blade of the food cutting device has an upper edge, a lower convexly cured and relatively blunt food cutting edge. The handle, as noted above, is located directly above the blade and more specifically above the food cutting edge of the blade and, preferably, extends along the entire length of the blade. In the preferred embodiment, the handle has a smooth concavely curved top and is both wide and long enough to provide a continuous hand grasping areas at, near, or between the ends of the handle. The cutting action of the present invention is accomplished by grasping the handle at two positions and alternately applying downward pressure at each area in a smooth, rocking motion.

The cutting device of the present invention may be stored in a holder having a flat bottom, vertical side walls and a preferably concavely curved top. The top has a centered groove along the length of the cutting device holder and serving as a slot for the blade portion of the cutting device.

In one embodiment of the present invention, the handle and the blade may be of different materials, e.g., a wooden handle for a steel blade. Alternatively, both the handle and the blade may be made of a single material such as plastic or other solid material.

One advantage of the present invention is that the concave design of the handle allows for moderate pressure to be applied directly above the tangent of the cut, thereby improving stability and generating increased cutting forces which allow the user to completely sever a pizza pie in a smooth, rocking motion.

Another advantage of the present invention is that it allows for a dull cutting edge without any loss of cutting effectiveness. A dull edge makes the product both safer and substantially maintenance free.

Further features of the present invention will become more fully apparent in the following description of the embodiments and from the appended claims.

DESCRIPTION OF THE DRAWINGS

FIG. 5 is a perspective view of an alternative embodiment of the present invention.

FIG. 9 is a perspective view of another alternative embodiment of the present invention.

FIG. 10 is a side view of the alternative embodiment of FIG. 9.

DETAILED DESCRIPTION OF THE INVENTION

Figure 1:
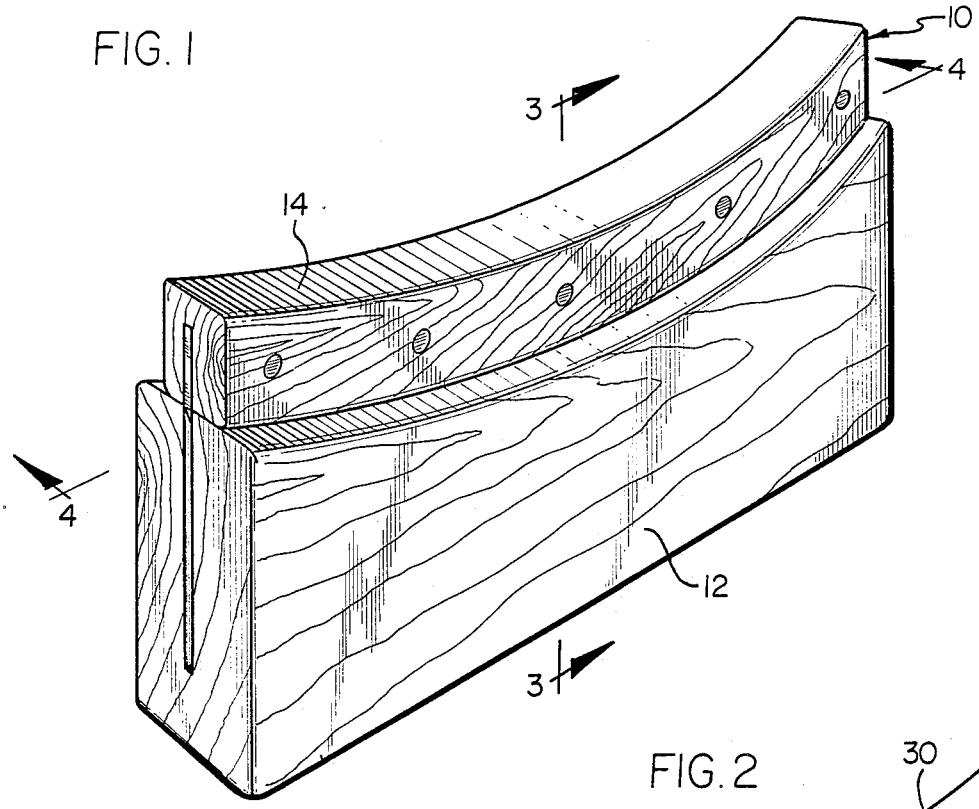
FIG. 1 is a perspective view of the food cutting device of the present invention in combination with the holder.
Figure 2:
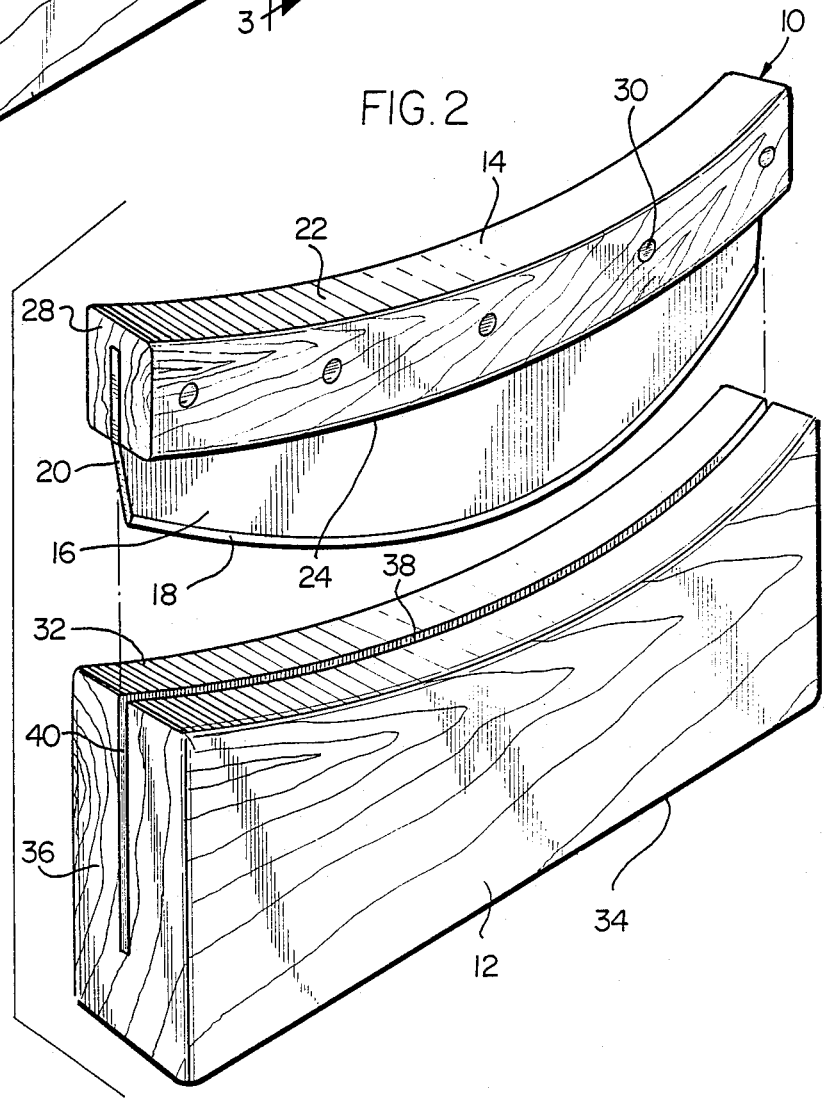
FIG. 2 is a perspective view showing the food cutting device of the present invention removed from the holder.
Figure 3:
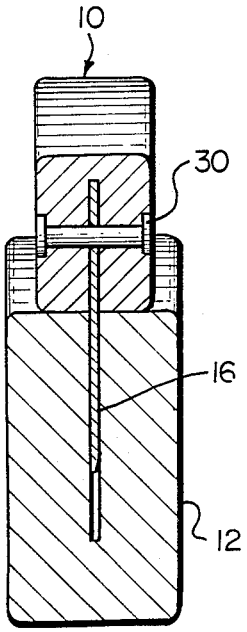
FIG. 3 is a side view of the food cutting device in a combination with the holder taken along line 3—3 of FIG. 1.

Turning now to the drawings, FIG. 1 shows a food cutting device 10 in combination with a holder 12 during non-use of the food cutting device. FIG. 2 shows the food cutting device 10 removed from the holder 12. As is further shown in FIG. 2, food cutting device 10 has a concavely curved handle 14 and a blade 16. The blade 16 has a convexly curved cutting edge 18 and sides 20. Handle 14 extends along the entire length of blade 16 with the top portion of the blade 16 attached to the bottom edge 24 of the handle 14 with attachment screws or, as shown in FIG. 2, rivets 30.

Holder 12 depicted in FIG. 1 and FIG. 2 has a top 32, a flat bottom 34 and sides 36. In the preferred embodiment, handle top 32 is concavely curved to coincide with the bottom edge 24 of the handle 14 as shown in FIG. 1. A center groove 38 runs along the entire length of the holder top 32 to form a receptacle 40 for receiving blade 16 of the cutting device 10 during non-use. Receptacle 40 extends downwardly into the body of holder 12 and is open at the sides 36. Alternatively, the holder sides 36 may be closed with receptacle 40 ending at a point spaced away from the ends of the holder and giving holder sides 36 a solid appearance as shown in FIG. 5.

Figure 4:
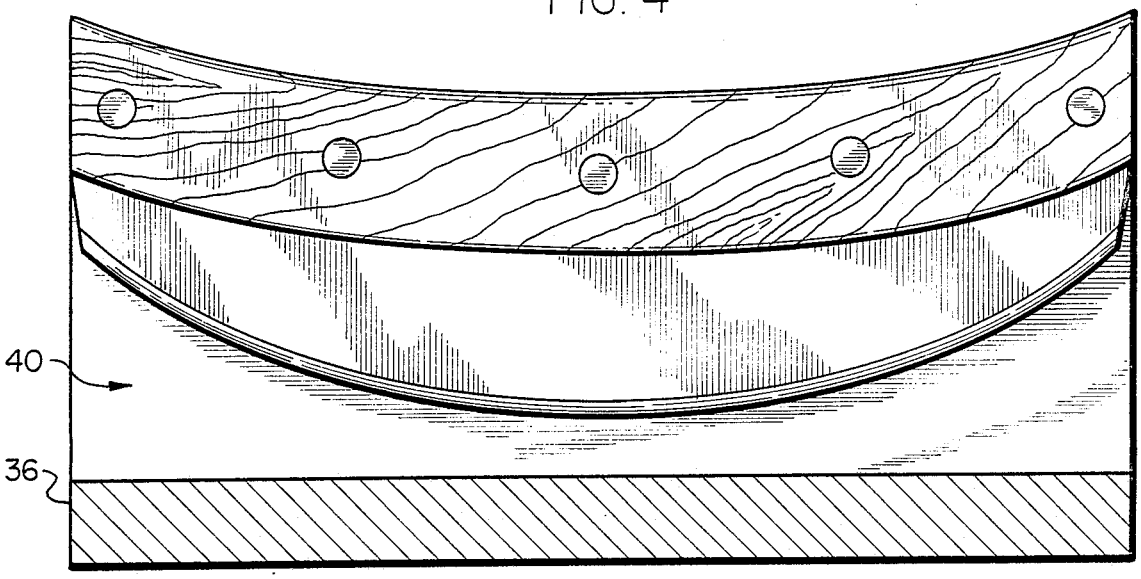
FIG. 4 is a cross-sectional view of one embodiment of the present invention taken along line 4—4 of FIG. 1.
Figure 8:
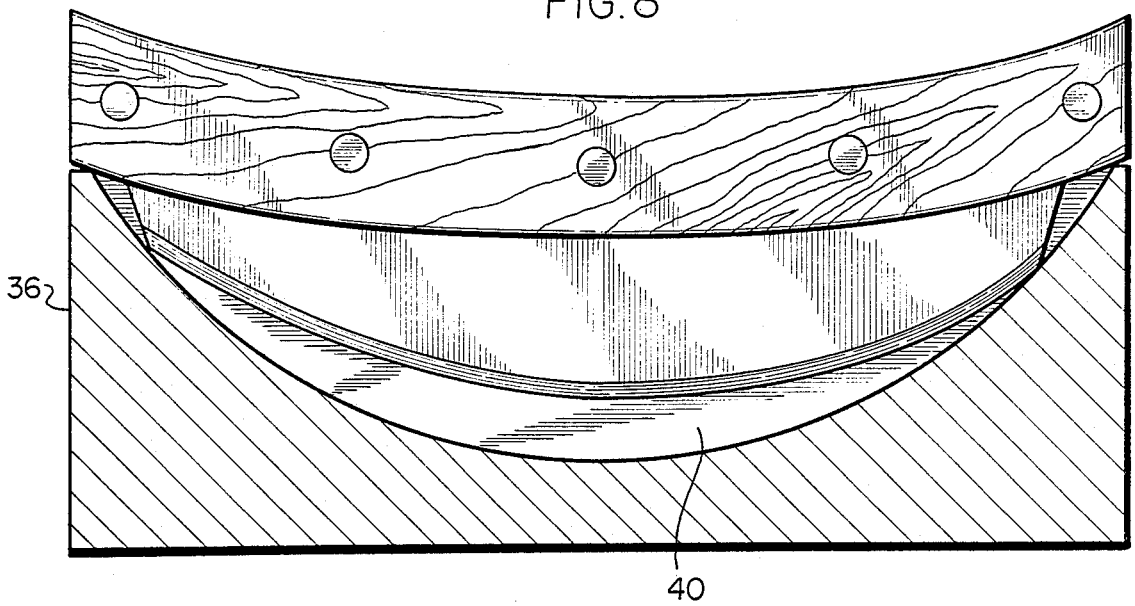
FIG. 8 is a cross-sectional view of another embodiment of the present invention taken along line 5—5 of FIG. 5.

This feature is more clearly shown in FIGS. 4 and 8. FIG. 4 shows the cutting device 10 inserted within the holder 12 (which is depicted in cross-section) with the holder having side openings 40. Alternatively, FIG. 8 shows the cutting device 10 inserted within the receptacle 40 of holder 12 (also shown in cross-section) with the sides of the holder 36 being solid.

Figure 6:
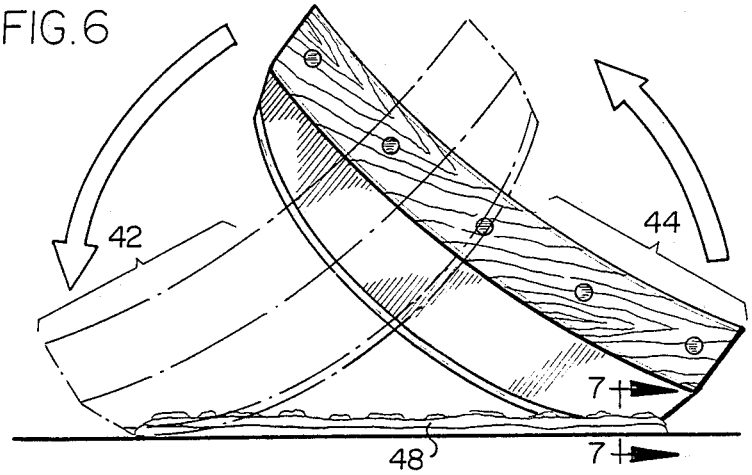
FIG. 6 is an elevational is a view of the food cutting device of the present invention indicating the cutting motion during use of the cutting device.

Use and operation of the food cutting device of the present invention is generally depicted in FIG. 6. The user places both hands on positions 42 and 44 and by alternately applying downward pressure at positions 42 and 44 in a smooth rocking motion as depicted on the arrows of FIG. 6, he severs the pizza into the desired slices.

Figure 7:
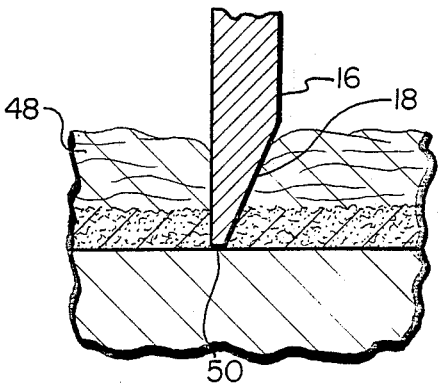
FIG. 7 is a cross-sectional side view of the cutting edge of the food cutting device of the present invention during use taken along line 7—7 of FIG. 6.

FIG. 7 shows, in detail, the cutting edge 50 of the blade of the cutting device 10. As mentioned earlier, blade 16 has a cutting edge 18 and a substantially blunt end 50.

In one example of the preferred embodiment described above, the blade is made of stainless steel or like material and measures between 10 and 18 inches in length, is approximately 1/16 of an inch thick and between 3 to 4 inches across. The handle is between 1 and 1½ inches wide and may be approximately 1 to 2 inches high running along the entire length of the blade. As for the holder, it will be between 1 and 3 inches wide and between 3 to 5 inches from bottom to top. Preferably, both handle and holder are made of a hardwood or other solid material.

An alternative embodiment of the present invention is depicted in FIGS. 9 and 10. FIGS. 9 and 10 show a food cutting device 10 having a handle 14 and a blade 16. As with the embodiment described above, the cutting edge 18 of blade 16 has a relatively blunt end 50. Unlike the earlier embodiment, however, the food cutting device 10 of the alternative embodiment is made of a single material, preferably a plastic. Generally, this "one-piece" alternative embodiment is smaller than the embodiment described in FIG. 1–7.

This description has been offered for illustrative purposes only and is not intended to limit the invention of this application, which is defined in the claims below.

I claim:

1. A food cutting device comprising:

an elongated blade having an upper edge, a lower food cutting edge, and straight sides extending from the outer ends of said lower food cutting edge to the outer ends of said upper edge, said lower edge being convexly curved and being relatively blunt; and an elongated handle affixed to said blade near the upper edge of said blade and directly above said lower food cutting edge, said handle extending continuously over at least the entire length of said blade, said handle having a smooth concavely curved top and being wide enough and long enough to provide a continuous hand grasping portion whereby the cutting action is achieved by grasping two positions on said hand grasping portion and alternately applying downward pressure at each position of said hand grasping portion in a rocking motion.

2. A food cutting device in accordance with claim 1, wherein said handle has a smooth convexly curved bottom substantially parallel to said handle top.

3. A food cutting device in accordance with claim 1, wherein said blade measures between 10–18 inches in length and about 4 inches between the top edge and the cutting edge of said blade.

4. A food cutting device in accordance with claim 1, wherein said handle is made of a first material and said blade is made of a second material, said handle being mounted to said blade.

5. A food cutting device in accordance with claim 1 wherein both said handle and said blade comprise a single piece of plastic.

6. The food cutting device of claim 1 or 5 wherein the straight sides of the blade are substantially vertical.

7. A food cutting device in combination with a self-supporting holder, said food cutting device comprising an elongated blade having an upper edge, a lower food cutting edge, and straight sides extending from the outer ends of said lower food cutting edge to the outer ends of said upper edge said lower edge being convexly curved and being relatively blunt; and an elongated handle affixed to said blade near the upper edge of said blade directly above said lower cutting edge, said handle extending continuously over at least the entire length of said blade, said handle having a smooth concavely curved top and being wide enough and long enough to provide a continuous hand grasping portion whereby the cutting action is achieved by grasping two positions on said hand grasping portion and alternately applying downward pressure at each position of said hand grasping portion in a rocking motion;

said holder comprising a flat bottom, equally sized vertical side walls, and a top, said top having a centered groove, said groove extending downwardly to form a receptacle for receiving the exposed blade portion of said cutting device during non-use of said cutting device, said groove being at least as long as the blade of said cutting device.

8. The combination of claim 7 wherein said holder has a concavely curved top.

9. The combination of claim 7 wherein said handle has a smooth convexly curved bottom substantially parallel to said handle top.

10. The combination of claim 7 wherein said blade measures between 10–18 inches in length and about 4 inches between the top edge and cutting edge of said blade.

11. The combination of claim 7 wherein said handle is made of a first material and said blade is made of a second material, said handle being mounted to said blade.

12. The combination of claim 7 wherein both said handle and said blade comprise a single piece of plastic.

13. The food cutting device of claims 7 or 11 wherein the straight sides of the blade are substantially vertical.

* * * * *